US005947827A

United States Patent [19]

Badger et al.

[11] Patent Number: 5,947,827

[45] Date of Patent: Sep. 7, 1999

[54] METHOD OF REDUCING SLIDING FRICTION OF THREADED ROLLED FASTENERS

[75] Inventors: Philip O. Badger; Leon Wadsworth, both of South Bend, Ind.

[73] Assignee: A.P.L., LLC, South Bend, Ind.

[21] Appl. No.: 09/007,008

[22] Filed: Jan. 14, 1998

[51] Int. Cl.[6] ..... B21H 3/02

[52] U.S. Cl. ..... 470/10

[58] Field of Search ..... 470/8, 9, 10, 11, 470/17, 18, 25; 72/42

[56] References Cited

U.S. PATENT DOCUMENTS

| | | | |
|---|---|---|---|
| 3,634,129 | 1/1972 | Benz . | |
| 4,023,225 | 5/1977 | Tochilkin et al. . | |
| 4,088,585 | 5/1978 | Karpen | 72/42 |
| 4,168,241 | 9/1979 | Kozima et al. | 72/42 |
| 4,528,079 | 7/1985 | Badger . | |
| 4,553,417 | 11/1985 | Badger . | |
| 4,913,927 | 4/1990 | Anderson | 427/37 |
| 5,221,170 | 6/1993 | Duffy et al. . | |
| 5,307,660 | 5/1994 | Stoutenburg | 72/42 |
| 5,325,732 | 7/1994 | Vogel | 470/18 |
| 5,482,637 | 1/1996 | Rao et al. . | |
| 5,547,424 | 8/1996 | Nielsen . | |
| 5,616,367 | 4/1997 | Spearin et al. . | |
| 5,616,544 | 4/1997 | Kalota et al. | 72/42 |
| 5,776,867 | 7/1998 | Przybylski et al. | 72/42 |

FOREIGN PATENT DOCUMENTS

| | | | |
|---|---|---|---|
| 6-277777 | 10/1994 | Japan | 470/10 |

OTHER PUBLICATIONS

Brochure "Electroless Nickel News," vol. 11, No. 1—Fall, 1994.

*Primary Examiner*—Joseph J. Hail, III
*Assistant Examiner*—Ed Tolan
*Attorney, Agent, or Firm*—Barnes & Thornburg

[57] ABSTRACT

A method for reducing sliding friction of threaded fasteners according to the present invention includes the steps of providing a threadless austenitic stainless steel blank, coating the surface of the blank with a lamellar solid material, such as molybdenum disulfide, by introducing the threadless blank into a solution of molybdenum disulfide suspended within a carrying agent such as isopropanol or n-Butyl alcohol, heating the coated fastener to accelerate evaporation of the carrying agent, and forming threads into the coated surface using a thread rolling technique characterized by moving the blank through a series of traversing serrated dies moving in opposite directions parallel to one another to exert pressure on the coated surface, thereby both forming threads without removing metal from the surface, and impregnating the surface and near surface structure with the low friction species. Fasteners manufactured according to the present method exhibit reduced sliding friction and increased clamping force.

13 Claims, 1 Drawing Sheet

METHOD OF REDUCING SLIDING FRICTION OF THREADED ROLLED FASTENERS

FIELD OF THE INVENTION

This invention relates generally to a method for reducing sliding friction of threaded fasteners, and more particularly to a method of implanting a lamellar solid material into the surface of a thread rolled, stainless steel fastener.

BACKGROUND OF THE INVENTION

Fastener preloading is generally considered to be the axial force exerted on a joint by the fastener. However, it is an oversimplification to approximate preloading by calculations of simple axial or longitudinal strain. The geometrical imperfections of a threaded fastener cause interference between the threads and the tapped hole of the corresponding member. Incorrect clamping stress is undesirable because it exaggerates these imperfections. Also, torsional strain, caused by surface friction, is introduced to the fastener within the tapped hole, and additional bending strains are introduced by misalignments such as the non-parallelism between the mating surfaces.

In general, frictional force is a force which resists sliding motion. Frictional force, which is proportional to applied load, can be overcome by translational force. However, the frictional coefficient of a surface is independent of both the applied load and the total surface area in sliding contacts. Thus, the total frictional force, as distinguished from the coefficient of friction, between for example, a threaded fastener and a tapped hole, is a function of the total area engaged in sliding contact, and the mechanical strength and composition of the near surface region of the respective components.

It is desirable to reduce the sliding friction between a fastener and a threaded bore because, with friction force reduced, an increased clamping force is available for a given torque value. Under classic tribological theory, low sliding friction is accomplished by mating a compliant member with another, non-compliant member. For example, the superficial hardness of a carbide pin makes it non-compliant relative to a chrome plated disc upon which it slides. Unfortunately, it is not always practical to provide a matching tribological couple such as a carbide pin and chrome plated disc. In fact, tribological mismatches in various technologies are not uncommon. Of particular significance here is the tribological couple mismatch between an austenitic stainless steel fastener and an aluminum, threaded bore.

Austenitic stainless steel fasteners are commonly used with aluminum. The friction emerging from torquing a stainless steel fastener, which is tribologically mismatched with the aluminum, into the aluminum produces thread galling. The galling which occurs when torquing a fastener into or out of a threaded bore may also be accelerated or exaggerated by the localized heating which results from torquing. The mechanism that produces the thread galling is explained by the "adhesion theory" which teaches that when two surfaces are in sliding contacts, the high points or tips of the opposing surface asperities engage and form metallic junctions due to their elasticity. These junctions result in abrasive deformations and increases in total frictional force. A translational force is required to shear these metallic junctions.

In addition to being tribologically mismatched with stainless steel, aluminum is generally known to be intrinsically abrasive. Aluminum machining or cutting equipment has a notoriously short service life. In various applications, such as avionics, aluminum components are typically protected by a low friction coating to prevent severe wear. Similarly, austenitic stainless steel is an intrinsically poor triboelement. The microstructure of austenitic stainless steel is known to weaken under the vibrational effects of sliding contact. Also, it is generally accepted that the abrasion rate of austenitic stainless steel is moderate to rapid.

Various attempts have been made to reduce sliding friction using solid lubricants. These attempts have generally involved surface processing to trap solid lubricant crystals into the near surface microstructure of the triboelement. For example, U.S. Pat. No. 4,240,886, U.S. Pat. No. 4,312,900, and U.S. Pat. No. 4,528,079 teach attempts to make lamellar solid low friction species surface or near surface components of a triboelement's microstructure to lower sliding friction and improve wear performance. U.S. Pat. No. 4,125,637 teaches a method of impinging the inside diameter of a wet cylinder sleeve with silicon carbide particles dispersed in the cooling oil while honing the cylinder wall to produce cross-hatching and improve geometrical precision.

Present day solid lubricant theory generally includes the uniform dispersal of a low friction species in a highly ordered, mechanically strong matrix. Lead for example, which acts as a solid lubricant, has been incorporated into the surface matrix of copper at concentrations beyond eutectic equilibriums using state of the art melting techniques in alloying technology. Similarly, carbon monofluoride has been co-deposited as a protective surface coating on electroless nickel (see U.S. Pat. No. 4,830,889). The carbon monofluoride is uniformly dispersed as a low friction species into the extremely fine grained, electroless nickel which serves as a highly ordered, strong, support matrix.

It is commonly known that the family of lamellar solids which includes carbon monofluoride, as well as tungsten disulfide and molybdenum disulfide, includes solids having crystal structures which result in low friction sliding. The crystal structure of these low friction species typically have weak Van der Waal type bonding in the plane perpendicular to the basal plane. This weak bonding provides low shear on sliding. The molybdenum disulfide crystal is particularly noteworthy because it exhibits anisotrophy on an order of magnitude of 29 to 1. Along the basal plane, the molybdenum disulfide crystal is fairly strong and can withstand the applied force required to impregnate the crystal into the surface of the triboelement. Thus, low sliding friction is possible using molybdenum disulfide, only if the molybdenum disulfide crystal is introduced into the surface of the triboelement at the proper geometric orientation. This degree of anisotrophy (i.e., inequality of physical properties along different axes), and the accompanying benefits, is not present in the carbon monofluoride crystal. Thus, the crystal structure of the carbon monofluoride species permits its use in nearly every conformal application, and its load carrying capacity will not be exceeded. However, this species exhibits very little anisotrophy. Thus, it is anticipated that carbon monofluoride will be combined with either Molybdenum disulfide or tungsten disulfide for mechanical inclusion according to present invention. It should also be noted that graphite could serve as a suitable lamellar solid material. The thermal stability for this entire family of solid lubricants is satisfactory for the types of applications contemplated by this invention. Molybdenum disulfide begins oxidation at 400° C. (752° F.). Tungsten disulfide begins oxidation at 452° C. (846° F.).

SUMMARY OF THE INVENTION

The present invention provides a method for mechanically including a low friction species into the microstructure of a stainless steel fastener, particularly austenitic stainless steel, during the process of thread rolling the surface of a fastener and thereby work hardening the material. This particular method for including a low friction species, such as molybdenum disulfide, tribologically enhances the surface and near surface of, for example, AISI types 302, 304 and 316 stainless steel for coupling with, for example, 2024, 6010, 6011, and 6061 aluminum in various tempers. The inclusions of the low friction species are mechanically trapped and included within the grains of "strain induced martensite," parallel to the direction of the thread rolling. The thread rolling process further orients the crystal of the low friction species to provide reduced sliding friction, thereby preventing excess thread galling and damage caused by excessive abrasion to both the threads of the fastener and the threads of the blind tapped hole. This reduced sliding friction also reduces the amount of unwanted torsional strain on the fastener upon application of torque or axial force and improves fatigue endurance of the fastener, while increasing the clamping stress provided by the fastener. It has also been determined through experimentation that introduction of the low friction species according to the present invention does not decrease the corrosion resistance of the threaded fastener.

Other features of the present invention will become apparent on consideration of the following description of exemplary embodiments.

DESCRIPTION OF EMBODIMENTS OF THE INVENTION

Figure 1:
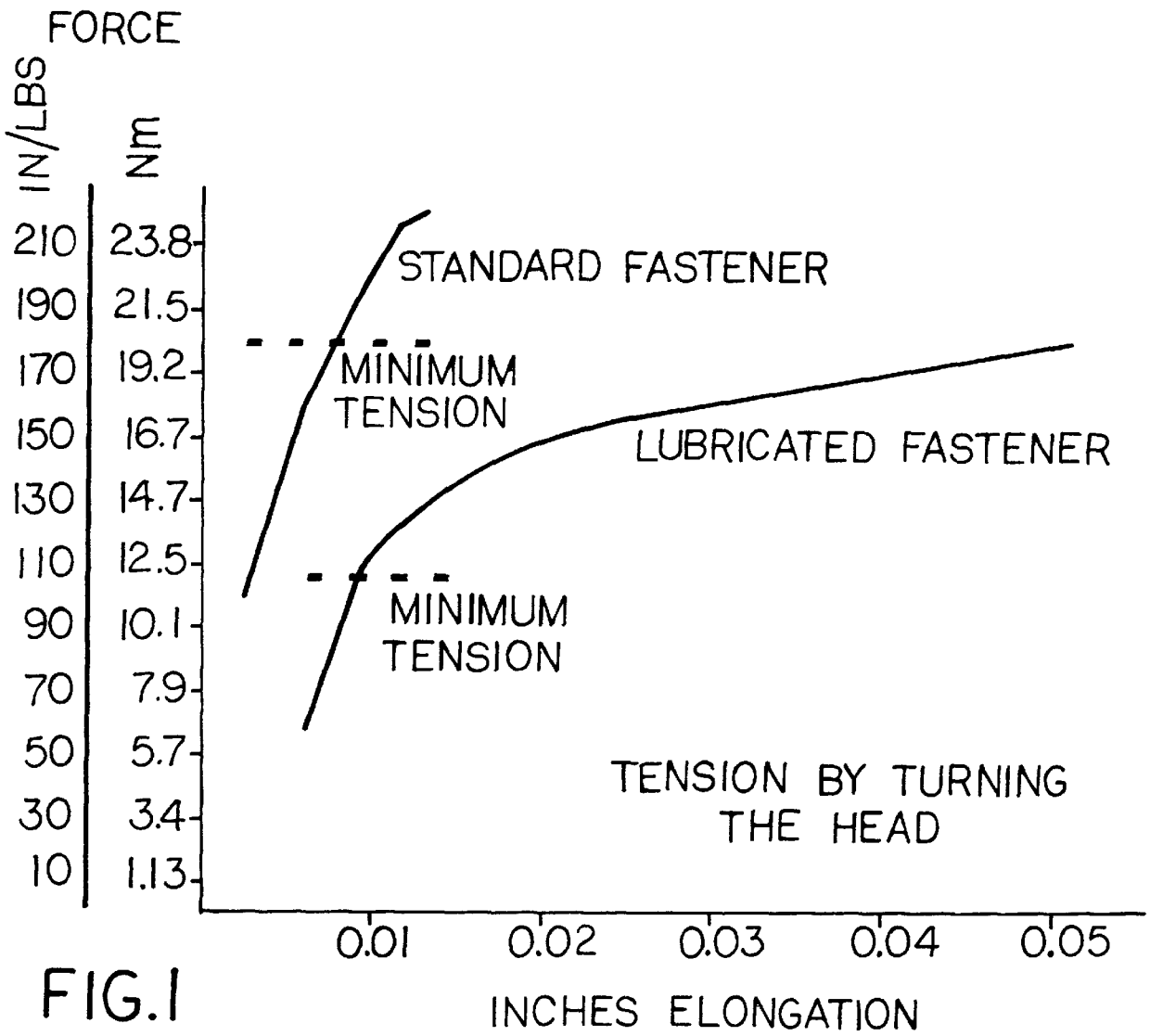
FIG. 1 is a graphical representation of the results of a conventional fastener elongation test.

The embodiments described herein are not intended to be exhaustive or to limit the invention to the precise forms disclosed. Rather the embodiments selected for description are disclosed so that others skilled in the art may utilize their teachings.

While the description provided herein explains the method of the present invention in the context of forming stainless steel fasteners, and particularly AISI type 302, 304, and 316 austenitic stainless steel fasteners for mating with various aluminum alloys, it should be understood that the basic principles of the present invention for reducing sliding friction are applicable to martensitic stainless steel as well as various other tribological couples. The method in this particular application begins by obtaining cold headed blanks consisting of an unthreaded shank with a bolt head on one end. For purposes of this description, assume the threadless steel blank is formed of austenitic stainless steel.

Next, a solution is prepared of a surface coating material containing molybdenum disulfide in the form of micrometer particles held in suspension in a carrying agent including isopropanol and n-Butyl alcohols. The solution can be contained in an open bath container having an agitation device or stirring mechanism to maintain the solids in full suspension within the carrying agent.

The threadless blanks are then coated with the coating solution by dipping the threadless shank portions of the blanks into the solution. Of course, one skilled in the art could readily coat the blanks using various techniques, such as spraying, passing the blanks through a standing curtain of the solution, etc. The blanks need only be in contact with the solution for a sufficient period of time such that the threadless shank is fully coated.

Once the blanks are sufficiently coated, they are introduced into an elevated temperature environment of about 100° C. (225° F.) while in a still wet state. The heated environment may be a heating chamber. The blanks may be transported through the chamber by a conveyor. The elevated temperature accelerates the vaporization process of the carrying agents, leaving behind a dry solid lubricant surface film on the blanks. The heat should be maintained for a period of time sufficient to provide a uniform solid film coating of the low friction species on the surface of the threadless shank of the blank.

The stainless steel blanks are then thread rolled. Thread rolling is one of several methods of imparting geometrically precise threads onto the outer surface of a cylindrical piece. Alternative methods of producing threads in the threaded fastener and screw machine industries are precision thread grinding, single point thread chasing and thread chasing using a geometric die head which houses the thread chasing dies and rotates at a high rotational speed, substantially faster than the speed of the collet of the screw machine that holds the part. The thread is chased on the outside of the part. Thread grinding and thread chasing, however, form threads only by removing material from the threadless shank. Thread rolling, on the other hand, forms the threads on the shank with traversing serrated dies moving in opposite directions parallel to one another. The dies exert extreme pressure on the surface of the cold headed shank, thus forming the threads without removing metal from the surface. The work piece rotates or spins as it proceeds through the dies on the thread rolling machine. It is well accepted in the industry that thread rolling is superior in strength to thread grinding or thread chasing.

As the coated blank is thread rolled, the molybdenum disulfide (or other low friction species) is forced into and becomes implanted within the surface and near surface structure of the fastener threads. As such, a fastener is formed by the process according to the present invention is self-lubricating in the sense that it contains solid lubricant within its surface microstructure, and remains self-lubricating as verified by the testing described below.

Quantitative measurements were taken on the performance of 16 bolts prepared according to the present invention. Four aluminum test blocks were prepared, each having four precision tapped blind holes (to accept ¼–20 UNC class 2 hexhead bolts). Using a Stanley Proto Electronic Torque Wrench having a range of 25 through 250 inch pounds with an accuracy and linearity of 1%, each of the 16 test bolts were torqued into a respective blind hole ten times at each of nine preset torque levels (72 inch pounds through 168 inch pounds at 12 inch pound increments). A standard grade 8 steel washer was used for each trial to protect the flat aluminum surfaces surrounding the tapped holes. Accordingly, 160 samples (10 trials and 16 bolts) were taken at each of nine preset torque values. The lubricated bolts were torqued into their respective holes by applying the preset torque force, then removed with the wrench, recording the torquing force required for such removal. Additionally, after each trial, the fastener was closely examined for evidence of thread galling or other thread damage. The tapped aluminum holes were inspected as well.

Lubricated bolts, fabricated according to the present invention, showed increased clamping stress at lower torque values. Plain stainless steel bolts at higher torque showed lower clamping stress. The lubricated bolts showed a 45 to 55% increase, relative to the plain bolts, in clamping stress. Additionally, over the course of 1,440 torque trials as outlined above, no evidence of thread galling or other thread damage was observed. Thus, the self-lubricating properties of the thread surfaces prepared according to the present invention exhibit extreme endurance and remain functional for the useful life of the thread rolled fastener.

Another sample of lubricated fasteners was subjected to a standard bolt elongation test, as is commonly employed in the art. The relationships between applied force and elongation for standard fasteners and fasteners lubricated according to the present invention are shown in FIG. 1.

Additionally, a sample lot of lubricated fasteners along with a sample of plain stainless steel bolts were introduced into a salt fog corrosion environment. The salt spray chamber conformed to ASTM B-117. The period of exposure was 336 hours. The test bolts showed no visual effects of corrosion. Thus, the mechanical implantation process of the low friction species described in the present specification does not accelerated oxidative corrosion of the stainless steel fasteners.

While this invention has been described as having exemplary embodiments, this application is intended to cover any variations, uses, or adaptations using its general principles. Further, this application is intended to cover such departures from the present disclosure as come within the known or customary practice within the art to which it pertains. The spirit and scope of the invention are to be limited only by the terms of the appended claims.

What is claimed is:

1. A method for reducing the sliding friction of threaded fasteners, comprising the steps of:

providing a stainless steel blank;

coating the surface of the blank with a lamellar solid material; and thread rolling the coated blank thereby including the lamellar solid material within the surface of the blank in a direction parallel to the direction of the thread rolling.

2. A method as claimed in claim 1 wherein the lamellar solid material is a low friction species.

3. A method as claimed in claim 1 wherein the lamellar solid material is a material from the family of lamellar solids which includes molybdenum disulfide.

4. A method as claimed in claim 2 wherein the low friction species includes a compound from the group consisting of molybdenum disulfide, tungsten disulfide, and carbon monofluoride.

5. A method as claimed in claim 1 wherein the lamellar solid material is suspended in a liquid carrying agent.

6. A method as claimed in claim 5 wherein the liquid carrying agent includes isopropanol.

7. A method as claimed in claim 5 wherein the liquid carrying agent includes n-Butyl alcohol.

8. A method as claimed in claim 1 wherein the coating step includes dipping the blanks into the lamellar solid material.

9. A method as claimed in claim 1 wherein the coating step includes spraying the blanks with the lamellar solid material.

10. A method as claimed in claim 1 further comprising the step of suspending the lamellar solid material in a liquid, the coating step including dipping the blanks into the liquid.

11. A method as claimed in claim 1 further comprising the step of drying the coated blanks by applying heat to the coated blanks.

12. A method as claimed in claim 11 wherein the step of drying the coated blanks includes introducing the coated blanks into a chamber having an internal temperature of approximately 225 degrees Fahrenheit.

13. A method as claimed in claim 1 wherein the stainless steel blank is an austenitic stainless steel blank.

* * * * *